United States Patent [19]

Resce et al.

[11] Patent Number: 4,732,168

[45] Date of Patent: Mar. 22, 1988

[54] SMOKING ARTICLE EMPLOYING HEAT CONDUCTIVE FINGERS

[75] Inventors: James L. Resce, Yadkinville; Thomas L. Gentry, Winston-Salem, both of N.C.

[73] Assignee: R. J. Reynolds Tobacco Company, Winston-Salem, N.C.

[21] Appl. No.: 864,647

[22] Filed: May 15, 1986

[51] Int. Cl.[4] ..... A24B 15/00; A24D 1/18

[52] U.S. Cl. ..... 131/359; 131/194; 131/335

[58] Field of Search ..... 131/335, 360, 361, 362, 131/364, 363, 359, 194

[56] References Cited

U.S. PATENT DOCUMENTS

| | | | |
|---|---|---|---|
| 1,770,616 | 7/1926 | Kean . | |
| 2,907,686 | 10/1959 | Siegel . | |
| 3,258,015 | 6/1966 | Ellis . | |
| 3,356,094 | 12/1966 | Ellis . | |
| 3,516,417 | 6/1970 | Moses . | |
| 3,738,374 | 6/1973 | Bennett . | |
| 3,885,574 | 5/1975 | Borthwick . | |
| 3,931,824 | 1/1976 | Miano . | |
| 3,943,941 | 3/1976 | Boyd . | |
| 4,008,723 | 2/1977 | Borthwick . | |
| 4,027,679 | 6/1977 | Kaswan . | |
| 4,044,777 | 8/1977 | Boyd . | |
| 4,079,742 | 3/1978 | Ranier . | |
| 4,219,032 | 8/1980 | Tabatznik | 131/170 |
| 4,284,089 | 8/1981 | Ray . | |
| 4,286,604 | 9/1981 | Ehretsmann . | |
| 4,326,544 | 4/1982 | Hardwick . | |
| 4,340,072 | 7/1982 | Bolt . | |
| 4,347,855 | 9/1982 | Lanzilotti . | |
| 4,474,191 | 10/1984 | Steiner . | |

FOREIGN PATENT DOCUMENTS

| | | |
|---|---|---|
| 276250 | 1/1964 | Australia . |
| 687136 | 5/1964 | Canada . |
| 117355 | 9/1984 | European Pat. Off. . |
| 174645 | 3/1986 | European Pat. Off. . |
| 956544 | 4/1964 | United Kingdom . |
| 1185887 | 3/1970 | United Kingdom . |

OTHER PUBLICATIONS

Guiness Book of World Records, pp. 242–243, 1985 Edition.

Guiness Book of World Records, p. 194, 1966 Edition.

Tobacco Substitutes, Noyes Data Corp. (1976).

*Primary Examiner*—V. Millin

*Attorney, Agent, or Firm*—Grover M. Myers; David G. Conlin

[57] ABSTRACT

The present invention relates to a cigarette-like smoking article which is capable of producing substantial quantities of aerosol, both initially and over the useful life of the product, preferably without significant thermal degradation of the aerosol former and without the presence of substantial pyrolysis or incomplete combustion products or sidestream smoke. Preferred articles of the present invention are capable of providing the user with the sensations and benefits of cigarette smoking without the necessity of burning tobacco.

These and other advantages are obtained by providing an elongated, cigarette-type smoking article which preferably utilizes a short, i.e., less than about 30 mm long, preferably carbonaceous, fuel element, and a physically separate aerosol generating means including an aerosol forming material, which means is in a conductive heat exchange relationship with the fuel element.

The aerosol generating means is preferably contained within a unitary heat conductive container having two or more finger-like extensions, each of which is in contact with at least a portion of the fuel element. This container is preferably prepared from a single conductive element, having two or more finger-like projections or "fingers" of from about 2 to 8 mm in length and about 0.5 to 3 mm in width. Most preferably, there are two or three fingers, which contact a total of from about 20 to 35 percent of the surface of the fuel element.

12 Claims, 6 Drawing Figures

SMOKING ARTICLE EMPLOYING HEAT CONDUCTIVE FINGERS

BACKGROUND OF THE INVENTION

The present invention relates to a cigarette-type smoking article having a heat conductive, preferably metallic enclosure therein. This article preferably produces an aerosol that resembles tobacco smoke and most preferably contains no more than a minimal amount of incomplete combustion or pyrolysis products.

The use of metallic enclosures in cigarette-type smoking articles is known. For example, in British Pat. No. 956,544, there is described a proposed cigarette-type smoking article having a steel tube combustion cartridge. This cartridge is filled with charcoal treated with $KClO_3$ or $KMnO_4$.

Ellis et al. (Ellis I), in U.S. Pat. No. 3,258,015 describes a proposed cigarette-type smoking article utilizing a heat conductive (metal) tube as a container for their aerosol forming materials. Heat from the burning fuel source surrounding the tube caused volatilization of the materials contained therein. Similar devices are described in Synectic British Pat. No. 1,185,887.

Likewise, in Steiner, U.S. Pat. No. 4,474,191, proposed smoking articles are described in which the mainstream aerosol comprised volatile and/or sublimable materials disposed within a channel separated from the heat source. A heat conductive member was used to transfer heat from the burning fuel to this aerosol generating means.

Ellis et al. (Ellis II), in U.S. Pat. No. 3,356,094, described a modification to their original design to eliminate the heat conducting metal tube which ultimately protruded from the lighting end of their smoking article as the fuel was consumed. The new design proposed a heat conductive tube made out of a material, such as certain inorganic salts or an epoxy bonded ceramic, which became frangible upon heating.

Kaswan, in U.S. Pat. No. 4,027,679, describes a cigarette having disposed therein a ceramic or metallic smoke vector, open at the lighting end and sealed at the mouth end. This vector is said to reduce the draw heat of the article, thereby reducing the amount of pyrolysis products in the aerosol.

Levavi, in Canadian Pat. No. 687,136 described proposed cigarettes with tubes, some of which were metal and some of which burned slowly, for controlling the amount of tars and nicotine delivered to the user.

Many other cigarette-type smoking articles have been proposed through the years, especially over the last 20 to 30 years.

For example, U.S. Pat. No. 4,079,742 to Rainer et al.; U.S. Pat. No. 4,284,089 to Ray; U.S. Pat. No. 2,907,686 to Siegel; U.S. Pat. No. 3,738,374 to Bennett; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; and European Patent Appln. No. 117,355 to Hearn, each describe cigarette-type smoking articles, but none of these articles have ever achieved any degree of commercial success.

Thus, despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention relates to a cigarette-type smoking article which is capable of producing substantial quantities of aerosol, both initially and over the useful life of the product, preferably without significant thermal degradation of the aerosol former and without the presence of substantial pyrolysis or incomplete combustion products or sidestream smoke. Preferred articles of the present invention are capable of providing the user with the sensations and benefits of cigarette smoking without the necessity of burning tobacco.

These and other advantages are obtained by providing an elongated, cigarette-type smoking article which preferably utilizes a short, i.e., less than about 30 mm long, preferably carbonaceous, fuel element, and a physically separate aerosol generating means including an aerosol forming material, which means is in a conductive heat exchange relationship with the fuel element. The conductive heat exchange relationship is achieved by a heat conductive member, including one or more heat conductive projections which extend toward the lighting end of the fuel element, which is contiguous to (e.g. contacts or in at least close proximity) at least a portion of both the fuel element and the aerosol generating means, and which preferably forms the container for the aerosol forming material. Conductive transfer of heat from the burning fuel element to the aerosol generating means causes volatilization of the aerosol forming material which in turn is delivered to the user in the form of a "smoke-like" aerosol through the mouth end of the article.

The use of heat conductive projections of the type described herein aids in the rapid transfer of heat from the burning fuel element to the aerosol generating means, thus assuring rapid formation of aerosol. The projections also permit the heat conduction member to extend closer to the lighting end of the fuel element without adversely affecting lighting or burning of the fuel element. The area of the fuel element covered by the projections should not be so great as to draw too much heat therefrom, i.e., such that the fuel element is extinguished. Rather, the preferred contact area should be that which ensures both early and high volume aerosol delivery. Such a preferred contact area has been determined to be from about 10 to 50 percent, most preferably from about 20 to 35 percent, of the peripheral surface of the fuel element.

The aerosol generating means is preferably contained within a unitary heat conductive container which is provided with two or more spaced finger-like projections, each of which is in contact with at least a portion of the fuel element. The finger-like projections are preferably from about 2 to 8 mm in length and about 0.5 to 3 mm in width. Most preferably, there are two or three finger-like projections. The projections are most preferably a part of the container (i.e., not an added member). The finger-like projections may extend along the full length of the fuel source or they may extend to within about 1 to 5 mm of the lighting end of the fuel element. Preferably the finger-like projections extend over at least about 50% of the length of the fuel element thus providing a pathway for the conduction of heat from the burning fuel element to the aerosol generating means.

The resulting improved heat transfer serves to remove more heat from the burning fuel element. The result is believed to be three-fold: (1) the combustion temperature is lowered; (2) the rate of carbon gasification is reduced and as a result the fuel is consumed at a slower rate; and (3) the production of CO is decreased because of the lower temperatures maintained in the burning coal. An associated advantage with the slow burn rate is that the puff count is increased. The use of the "finger-capsule" of the present invention has also been shown to increase the overall aerosol delivery (measured as WTPM) in comparison with similar devices without projections such as those described in EPO Publication No. 174,645 (Sensabaugh et al.).

The container (including the projections) generally has an overall diameter of from about 3 to 8 mm, and a length of from about 25 to 40 mm. Alternatively, the aerosol generating means may be housed within a capsule formed from a plurality of heat conductive elements, arranged so as to form a container, and the conductive projections may be prepared from alternate heat conductive components, such as a metallic or other conductive elements, in the form of tapes and/or pastes. The use of such alternate materials allows for the formation of heat conduction members having non-linear designs and patterns, e.g., rings, stripes, spirals, helices (single & double), and the like.

The use of the modified heat conductive container of the present invention results in a rapidly bringing the aerosol generating means to a sufficiently high temperature to cause volatilization of the aerosol forming material, especially because the contact of the projections with the burning fuel element affords a rapid transfer of heat to the remainder of the container. Since the conductive container surrounds the aerosol forming material, the conductive nature of the materials used to construct the container causes rapid and preferably even heating of any substances contained therein.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3.0 mg or more of aerosol in the first 3 puffs when smoked under FTC smoking conditions. Moreover, preferred embodiments of the invention deliver an average of at least about 0.8 mg of WTPM per puff for at least about 6 puffs, preferably for at least about 10 puffs, under FTC smoking conditions.

In addition to the aforementioned benefits, preferred cigarette-type smoking articles of the present invention are capable of providing an aerosol which is chemically simple, consisting essentially of air, oxides of carbon, water, aerosol former including any desired flavors or other desired volatile materials, and trace amounts of other materials. This aerosol has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the container for the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. In the present cigarette-type smoking articles, the conductive heat exchange relationship is ensured by placing the aerosol generating means in contact with the fuel element by utilizing a conductive member having a plurality of finger-like extensions which contact the fuel element and carry heat from the burning fuel to the aerosol generating means.

As used herein, the term "carbonaceous" means primarily comprising carbon.

The preferred cigarette-type smoking articles of the present invention are described in greater detail in the accompanying drawings and in the detailed description of the invention which follow.

DETAILED DESCRIPTION OF THE PREFERRED EMBODIMENTS

Figure 1:
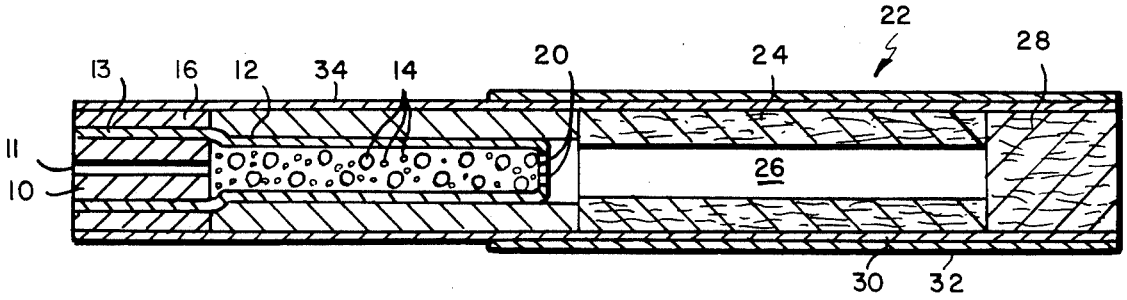
FIG. 1 is a longitudinal view of one embodiment of the invention.

FIG. 1 illustrates an embodiment of the cigarette-type smoking article of the present invention including fuel element 10, having one or more passageways 11. Overlapping the fuel element 10 are the finger-like projections 13 of metallic container 12, from about 0.5 to 2 mm in width and from about 2 to 8 mm in length. The container holds a substrate material 14 which includes at least one aerosol forming substance.

The periphery of fuel element 10 in this embodiment is surrounded by a jacket 16 of resilient insulating fibers, such as glass fibers, and container 12 is surrounded by a jacket of tobacco 18. The rear portion of container 12 is sealed and is provided with 2 slits 20 each (0.65 mm×3.45 mm) for the passage of the aerosol forming materials to the user.

At the mouth end of tobacco jacket 18 is situated a mouthend piece 22 comprised of a cellulose acetate cylinder 24 which provides aerosol passageway 26, and a low efficiency cellulose acetate filter piece 28. As illustrated, the article (or portions thereof) is overwrapped with one or more layers of cigarette papers 30, 32 and 34.

Figure 1A:
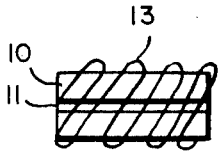
FIGS. 1A–1C are longitudinal views of various finger-like projection patterns useful herein.
Figure 1B:
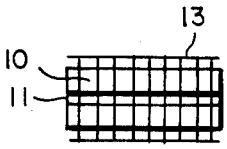
Figure 1C:
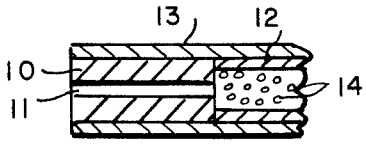

In addition to the use of metallic finger-like projections, or as an alternative thereto, a heat conductive paste or tape can be applied to the finished core assembly of the fuel element and the capsule. As illustrated in FIGS. 1A–1C, a heat conductive, e.g., metal paste or tape can be applied in various designs to conduct heat from the burning fuel element to the aerosol generating means. As illustrated, FIG. 1A depicts a spiral pattern of a heat conductive paste 13 surrounding the fuel element 10; FIG. 1B shows a grid pattern prepared using a heat conductive paste 13 and FIG. 1C represents a thick heat conductive tape 13 contacting both the fuel element 10 and the capsule 12. Many of these designs will complement the high speed manufacture of the articles.

For example, the exterior surface of the fuel source may be coated with a conductive paste or tape in a continuous manner such that the paste/tape overlaps both the fuel element and the capsule. Conductive pastes may be prepared from any good heat-conducting material such as Grafoil, powdered metals, and the like, in a suitable binder and/or adhesive. Similarly, conductive tapes may be prepared from metal powders admixed with tape materials. Aluminum tapes are one well known example.

In one preferred embodiment, two paste projections, each about 2 mm wide, and about 1½ mm thick, extend from the lighting-end of the fuel source about 10 mm to contact the lighting end of the capsule. The paste can also be extended the full length of the capsule (preferably 30 mm). The paste can also be applied in many different patterns, e.g., a grid, spirals, rings, strips, and the like.

In addition to conducting heat from the fuel element to the aerosol generating means, the metal paste or tape may be used to seal, if desired, the junction between the capsule and fuel source to prevent air leaks in the assembly.

Upon lighting the aforesaid embodiment, the fuel element burns, generating the heat used to volatilize the aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

In addition, the preferred fuel element usually begins to burn over substantially all of its exposed length within a few puffs. Thus, that portion of the fuel element in contact with the finger-like projections of the capsule becomes hot quickly, which significantly increases heat transfer to the aerosol generator, especially during the early puffs.

In general, the combustible fuel elements which may be employed in practicing the invention are less than about 30 mm long. Preferably the fuel element is about 20 mm or less, more preferably about 15 mm or less in length. Advantageously, the diameter of the fuel element is about 8 mm or less, preferably between about 3 and 7 mm, and more preferably between about 4 to 6 mm. The density of the fuel elements which may be employed herein range from about 0.5 g/cc to about 1.5 g/cc as measured, e.g., by mercury displacement. Preferably, the density is greater than 0.7 g/cc., more preferably greater than 0.8 g/cc. In most cases, a high density material is desired because it helps to ensure that the fuel element will burn long enough to simulate the burning time of a conventional cigarette and that it will provide sufficient energy to generate the required amount of aerosol.

The fuel elements employed herein are advantageously molded or extruded from comminuted tobacco, reconstituted tobacoo, or tobacco substitute materials, such as modified cellulosic materials, degraded or prepyrolyzed tobacco, and the like. Suitable materials include those described in U.S. Pat. No. 4,347,855 to Lanzilotti et al., U.S. Pat. No. 3,931,824 to Miano et al., and U.S. Pat. Nos. 3,885,574 and 4,008,723 to Brothwick et al. and in Sittig, *Tobacco Substitutes,* Noyes Data Corp. (1976). Other suitable combustible materials may be employed, as long as they burn long enough to simulate the burning time of a conventional cigarette and generate sufficient heat for the aerosol generating means to produce the desired level of aerosol from the aerosol forming material.

Preferred fuel elements normally include combustible carbon materials, such as those obtained by the pyrolysis or carbonization of cellulosic materials, such as wood, cotton, rayon, tobacco, coconut, paper, and the like. In most cases, combustible carbon is desirable because of its high heat generating capacity and because it produces only minimal amounts of incomplete combustion products. Preferably, the carbon content of the fuel element is about 20 to 40% by weight, or more.

The most preferred fuel elements useful in practicing this invention are carbonaceous fuel elements (i.e., fuel elements primarily comprising carbon) which are described and claimed in EPO Publication No. 174,654 to Sensabaugh et al.

Carbonaceous fuel elements are particularly advantageous because they produce minimal ash, and have high heat generating capacity. In especially preferred embodiments, the aerosol delivered to the user has no significant mutagenic activity as measured by the Ames test. See Ames et al., *Mut. Res.,* 31: 347–364 (1975); Nagas et al., *Mut. Res.,* 42: 335 (1977).

Burn additives or combustion modifying agents also may be incorporated into the fuel to provide the appropriate burning and glow characteristics. If desired, fillers, such as diatomaceous earth, and binders, such as sodium carboxymethyl cellulose (SCMC), also may be incorporated into the fuel. Flavorants, such as tobacco extracts, may be incorporated into the fuel to add tobacco or other flavor to the aerosol.

Preferably, the fuel element is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

Generally, a large number of passageways, e.g., about 5 to 9 or more, especially with a relatively close spacing between the passageways such that the passages coalsece, at least at the lighting end, during burning, produce high convective heat transfer, which leads to high aerosol delivery. A large number of passageways also generally helps assure ease of lighting.

The preferred carbonaceous fuel elements are generally from about 5 to 15 mm, preferably, from about 8 to 12 mm in length. Preferably, the density is greater than 0.7 g/cc as measured by mercury intrusion. Carbonaceous fuel elements having these characteristics are sufficient to provide fuel for at least about 7 to 10 puffs, the normal number of puffs generally obtained by smoking a conventional cigarette under FTC conditions.

A preferred carbonaceous fuel element is a pressed or extruded mass of carbon prepared from a powdered carbon and a binder, by conventional pressure forming or extrusion techniques. Preferred nonactivated carbons for pressure forming are prepared from pyrolized cotton or pyrolized papers, such as non-talc containing grades of Grande Prairie Canadian Kraft, available from the Buckeye Cellulose Corporation of Memphis, TN. A preferred activated carbon for such a fuel element is PCB-G, and another preferred non-activated carbon is PXC, both of which are available from Calgon Carbon Corporation, Pittsburgh, Pa.

An extruded carbonaceous fuel is preferably prepared by admixing from about 50 to 99 weight percent, most preferably about 80 to 95 weight percent, of the carbonaceous material, with from 1 to 50 weight percent, most preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency.

The dough is then extruded using a standard ram or piston type extruder into the desired shape, with the desired number and configuration of passageways, and dried, preferably at about 95° C. to reduce the moisture content to about 2 to 7 percent by weight.

Alternatively, the passageways may be formed using conventional drilling techniques. If desired, the lighting end of the fuel elements may be tapered or reduced in diameter by machining, molding, or the like, to improve lightability.

The preferred fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites, and the like, also may be used.

If desired, carbon/binder fuel elements (without tobacco, and the like) may be pyrolyzed after formation, for example, at at least about 650° C., preferably at about 850° C., for several hours, to convert the binder to carbon and thereby form a virtually 100% carbon fuel element.

The aerosol generating means used in practicing this invention is physically separate from the fuel element. By physically separate it is meant that the aerosol forming materials are not mixed with, or a part of, the fuel element. This arrangement helps reduce or eliminate thermal degradation of the aerosol forming substance and the presence of sidestream smoke.

The aerosol generating means used in the invention is advantageously spaced or recessed no more than about 30 mm, preferably no more than 20 mm, most preferably no more than 5–15 mm from the lighting end of the fuel element. The container or capsule for the aerosol generating means (excluding the finger-like projections) may vary in length from about 10 mm to about 55 mm, preferably from about 20 mm to 40 mm, and most preferably from about 25 mm to 35 mm. The diameter of the container or capsule may vary from about 2 mm to about 8 mm, preferably from about 3 to 6 mm.

The heat conducting material preferably employed in constructing the preferred capsule for the aerosol generating means is typically a metallic tube, strip, or foil, such as aluminum, varying in thickness form less than about 0.01 mm to about 0.1 mm, or more. The thickness and/or the type of conducting material may be varied (e.g., other metals or Grafoil, from Union Carbide) to achieve virtually any desired degree of heat transfer. As shown in the illustrated embodiment, the finger-like projections of the heat conducting capsule contact or overlap the fuel element.

Preferably, the aerosol generating means includes one or more thermally stable materials which carry one or more aerosol forming substances. As used herein, a "thermally stable" material is one capable of withstanding the high, albeit controlled, temperatures, e.g., from about 350° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments (infra).

While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

An especially useful alumina substrate is available from the Davison Chemical Division of W. R. Grace & Co. under the designation SMR-14-1896. Before use, this alumina is sintered at elevated temperatures, e.g., greater than 1000° C., washed, and dried.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout, prior to formation of the final substrate.

The fuel element insulating members employed in practicing the invention are preferably formed into a resilient jacket from one or more layers of an insulating material. Advantageously, this jacket is at least about 0.5 mm thick, preferably at least about 1 mm thick, more preferably between about 1.5 to 2 mm thick. Preferably, the jacket extends over more than about half, if not all of the length of the fuel element.

The currently preferred insulating fibers are ceramic fibers, such as glass fibers. Two suitable glass fibers are available from the Manning Paper Company of Troy, N.Y., under the designations, Manniglas 1000 and Manniglas 1200. When possible, glass fiber materials having a low softening point, e.g., below about 650° C., are preferred. The preferred glass fibers include experimental materials produced by Owens-Corning of Toledo, Ohio under the designations 6432 and 6437.

In most embodiments of the invention, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the heat fire cone away from the mouth and fingers of the user, and provides sufficient time for the hot aerosol to cool before reaching the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include a cellulose acetate tube as illustrated in FIG. 1, in which the cellulose acetate tube 24 acts as a resilient outer member to help simulate the feel of a conventional cigarette in the mouth end portion of the article. Another preferred mouthend piece includes a short, about 5–15 mm, annular cellulose acetate section, adjacent the aerosol generating means, and an adjoining section of non-woven polypropylene fibers, preferably rolled into a tube of complementary size to the cellulose acetate section. Other suitable mouthpieces will be apparent to those of ordinary skill in the art.

The mouthend pieces of the invention may include an optional "filter" tip, which is used to give the article the appearance of the conventional filtered cigarette. Such filters include low efficiency cellulose acetate filters and hollow or baffled plastic filters, such as those made of polypropylene. Such filters do not appreciably interfere with the aerosol delivery.

The entire length of the article, or any portion thereof, may be overwrapped with one or more layers of cigarette paper. Preferred papers at the fuel element end should not openly flame during burning of the fuel element. In addition, the paper should have controllable smolder properties and should produce a grey, cigarette-like ash.

The aerosol produced by the preferred articles of the present invention is chemically simple, consisting essentially of air, water, oxides of carbon, the aerosol former, any desired flavors or other desired volatile materials, and trace amounts of other materials.

The wet total particulate matter (WTPM) produced by the preferred articles of this invention has no measurable mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al. *Mut. Res.*, 31: 347–364 (1975); Nagas et al., *Mut. Res.*, 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The cigarette-like smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

The finger capsules of the present invention were prepared from 40 mm×4.5 mm aluminum tubing having a wall thickness of about 4 mil (0.004 in./0.1016 mm).

The rear 2 mm of the capsule was crimped closed to provide a container for an aerosol forming substance. The open end of the capsule is then shaped with scissors to produce a 30 mm body having at least two finger-like projections protruding 8 mm from the open end. Models with two and three equally spaced projections have been prepared and tested for the effect of the projections on performance.

Temperatures were measured on the surface of the capsule body 5, 15 and 25 mm back from the end of the finger-like projections. The fuel sources employed in the temperature measurements were prepared as in Example 2 and were 10 mm in length, with 2 mm inserted inside the capsule body.

Preferred finger-capsules had three finger-like projections, each 1.0 mm wide, so that about 20% of the surface area of the fuel element was covered by the aluminum finger-like projections (the combined width of the projections was 3 mm, while the circumference of the entire capsule is 14 mm).

Puff by puff temperartures were obtained and compared to identical smoking articles utilizing identical capsules but without finger-like projections. These data are presented in graphical form in FIGS. 2 and 3. In obtaining the data represented in these Figures, the second puff was taken 4 seconds following the first puff but the succeeding puffs were all 60 seconds apart.

Figure 2:
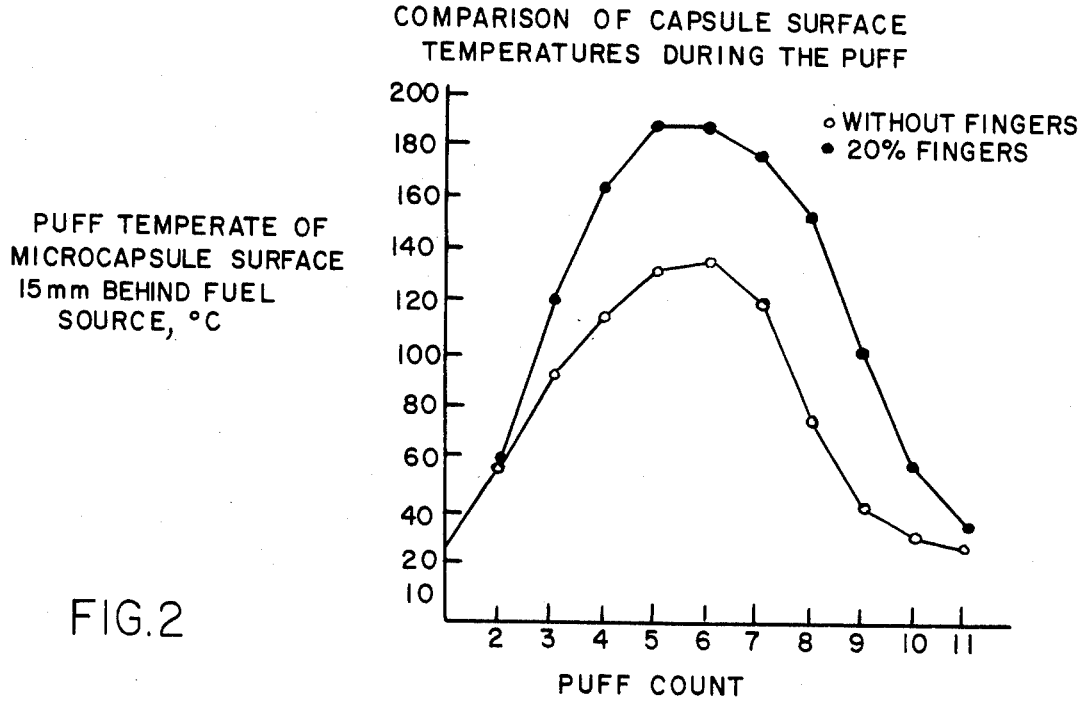
FIG. 2 illustrates comparative temperature data during puffing of the capsule surface for (a) a capsule having no projections; and (b) a capsule with projections contacting 20% of the fuel element surface area.
Figure 3:
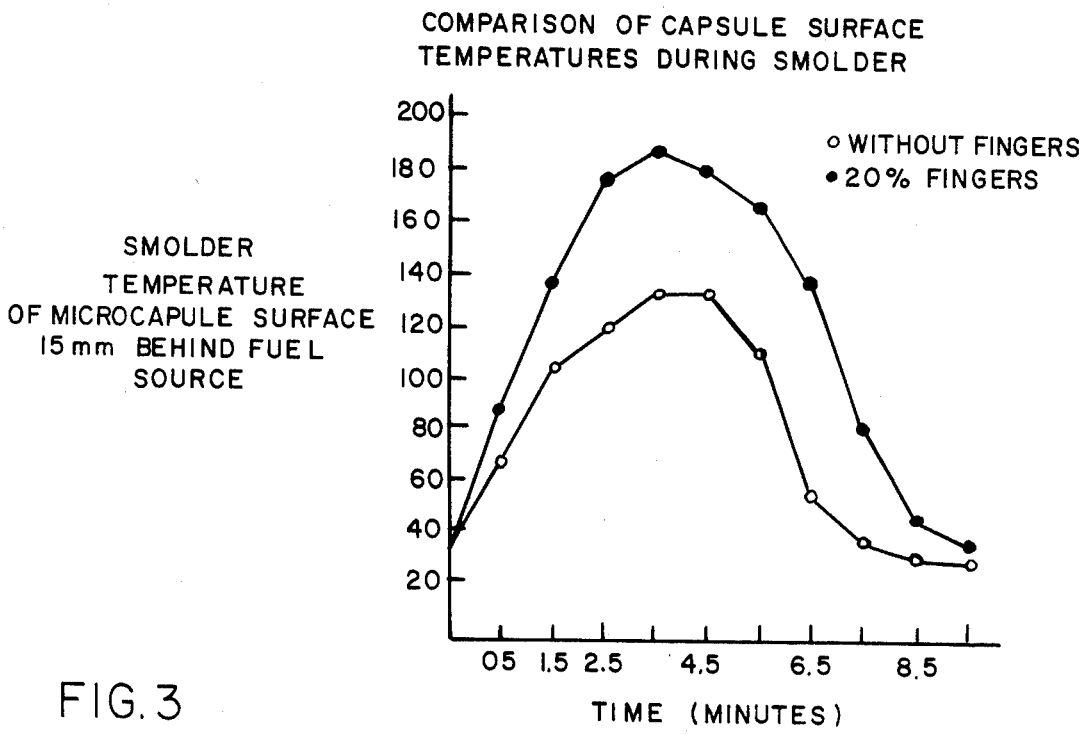
FIG. 3 illustrates comparative temperature data during smolder of the capsule surface for (a) a capsule having no projections; and (b) a capsule with projections contacting 20% of the fuel element surface area.

FIG. 2 shows the maximum temperatures recorded during the puff while the smolder temperatures are depicted in FIG. 3.

EXAMPLE 2

Smoking articles of the type substantially as illustrated in FIG. 1 were prepared from an extruded carbon fuel element in the following manner.

The fuel element (10 mm long, 4.5 mm o.d.) having an apparent (bulk) density of about 0.86 g/cc, was prepared with by extruding an admixture of 90 wt. percent carbon, 10 wt. percent SCMC binder and 1 wt. percent $K_2CO_3$ in a standard ram type extruder. The fuel element was extruded to have 7 holes (each 0.66 mm diameter) in a closely spaced arrangement with a core diameter (i,e., the diameter of the smallest circle which will circumscribe the holes in the fuel element) of about 2.6 mm and spacing between the holes of about 0.3 mm.

The carbon for the fuel element was prepared by carbonizing a non-talc containing grade of Grande Prairie Canadian Kraft paper under a nitrogen blanket, at a step-wise increasing temperature rate of about 10° C. per hour to a final carbonizing temperature of 750° C.

After cooling under nitrogen to less than about 35° C., the carbon is ground to a mesh size of minus 200. The powdered carbon was then heated to a temperature of about 850° C. to remove volatiles.

After cooling under nitrogen to less than about 35° C., the carbon was ground to a fine powder, having an average particle size of from about 10 to 50 microns.

This powder was admixed with the SCMC binder and $K_2CO_3$ and sufficient to water to make a stiff, dough-like paste which was then extruded and dried, affording the described fuel elements.

The capsule used to construct the illustrated smoking article was similar to that of Example 1, i.e., about 40 mm in length, having an outer diameter of about 4.5 mm. The rear 2 mm of the container was crimped to seal the mouth end of the container. The open end of the capsule was cut to provide three finger-like projections, equally spaced, each about 8 mm in length and 2 mm in width. The mouth end of the capsule was provided with two slot-like openings (each about 0.65×3.45 mm, spaced about 1.14 mm apart) to allow passage of the aerosol former to the user.

To provide tobacco flavors to the mainstream aerosol, the aerosol generating means included a spray dried tobacco extract. This extract was prepared as follows:

Flue Cured tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C. The nicotine content of the resulting extract was about 8.5 weight percent.

The substrate material for the aerosol generating means was a high surface area alumina (surface area=280 $m^2/g$) such as that available from W. R. Grace & Co. (designated SMR-14-1896), having a mesh size of from −8 to +14 (U.S.). Before use herein, this alumina was sintered at a soak temperature above about 1400° C., preferably from about 1400° to 1550° C., for about one hour and cooled. The alumina was then washed with water and dried.

This sintered alumina was first combined with an aqueous solution containing the spray dried flue cured tobacco extract, then treated with levulinic acid, and glycerin to a final weight percentage as follows:

| | |
|---|---|
| Alumina | 66.0% |
| Spray Dried FC | 10.7% |
| Glycerin | 22.6% |
| Levulinic Acid | 0.7% |

The finger capsule was filled with about 200 mg of this treated alumina.

The fuel element was inserted into the open end of the filled capsule to a depth of about 2 mm, the exposed 8 mm being contacted by the finger-like projections. The fuel element-capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm.

A 7.5 mm diameter tobacco rod (28 mm long) with a 646 plug wrap overwrap (e.g., from a non-filter cigarette) was modified to have a longitudinal passageway (about 4.5 mm diameter) therein. The jacketed fuel element-capsule combination was inserted into the tobacco rod passageway until the glass fiber jacket abutted the tobacco. The glass fiber and tobacco sections were overwrapped with Kimberly-Clark P 780-63-5 and then P 878-16-2 papers.

A cellulose acetate mouthend piece (30 mm long), of the type illustrated in FIG. 1, was joined to a filter element (10 mm long) with a nonporous plug wrap. This mouthend piece section was joined to the jacketed fuel element-capsule section by a paper overwrap and tipping paper was applied over the mouth end.

EXAMPLE 3

Smoking articles such as those described in Example 2, have also been tested for the effect of the finger-like projections on the production of aerosol, as measured by WTPM.

Smoking articles were prepared as in Example 2, but PG-60 carbon, loaded with 30% glycerin was used as the substrate material. The substrate was situated in the rear ⅔ of the capsule substantially as described in Example 2.

WTPM delivery for articles having two projections 3 mm long and 2 mm wide (covering 28% of the fuel) averaged 21.4 mg, while capsules without projections averaged only 13.7 mg WTPM.

EXAMPLE 4

The $CO/CO_2$ ratio for smoking articles of the present invention was tested using finger capsules prepared as in Example 1, which contacted a variable portion of the exposed fuel surface area (25% and 50%).

The fuel element (100 mg, 10 mm long, 4.5 mm in diameter) was prepared as in Example 2, except that the hole configuration following extrusion was that of a four part wedge or segment.

The results of FTC smoking tests of such capsules were as follows:

| Capsule Type | Puffs | CO (mg) | CO per puff |
|---|---|---|---|
| control (no fingers) | 6 | 18 | 3.0 |
| 25% fingers | 7.3 | 17.5 | 2.4 |
| 50% fingers | 7.3 | 13 | 1.8 |

EXAMPLE 5

One particularly preferred metal paste for use in place of the finger capsules of the present invention was prepared as follows:

A 10 ml base solution was prepared by mixing 9 ml normal water and 1 ml sodium silicate. To this base solution was added 2 g of fine aluminum powder. To this mixture was added 10 drops (about 0.01 g) ethyl alcohol. This mixture was stirred until a paste formed.

Three smoking articles were constructed essentially as described in Example 2, but using the above described aluminum paste and a capsule without finger-like projections. These articles were tested for heat delivery versus other methods and a control without finger-like projections and found to be equivalent to the "finger" models.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A cigarette-type smoking article comprising:

(a) a combustible fuel element;

(b) a physically separate aerosol generating means including an aerosol forming material; and (c) a heat conductive member which is contiguous to both the fuel element and the aerosol generating means, said member having at least two spaced heat conductive projections which extend toward the lighting end of said fuel element.

2. A cigarette-type smoking article comprising:

(a) a combustible carbonaceous fuel element less than about 30 mm in length;

(b) a physically separate aerosol generating means including an aerosol forming material; and (c) a heat conductive container which at least partially encloses the aerosol forming material, said container having at least one heat conductive projection which is contiguous to up to about 50 percent of the periphery of said fuel element.

3. The cigarette-type smoking article of claim 2, wherein the heat conductive projection contacts up to about 35 percent of the periphery of the fuel element.

4. The cigarette-type smoking article of claim 1, 2, or 3, wherein the heat conductive projection extends to the lighting end of the fuel element.

5. The smoking article of claim 1, 2, or 3 wherein the projection extends over at least one-half the length of the fuel element.

6. The cigarette-type smoking article of claim 1, 2, or 3, wherein said heat conductive projection is metallic.

7. The cigarette-type smoking article of claim 1, 2, or 3, wherein the heat conductive projection is formed from a heat conductive paste.

8. The cigarette-like smoking article of claim 7, wherein the projection contacts about 20 percent of the periphery of the fuel element.

9. The cigarette-like smoking article of claim 1, 2, or 3, wherein the heat conductive projection is formed from a heat conductive tape.

10. The cigarette-like smoking article of claim 9, wherein the projection contacts about 20 percent of the periphery of the fuel element.

11. The cigarette-like smoking article of claim 1, 2, or 3, comprising three heat conductive projections.

12. The cigarette-like smoking article of claim 11, wherein the total peripheral surface of the fuel element contacted by the heat conductive projection is at least 20 percent.

* * * * *